US011737551B2

(12) United States Patent
Fung

(10) Patent No.: US 11,737,551 B2
(45) Date of Patent: Aug. 29, 2023

(54) QUICK SLIDE-OUT-TYPE OUTDOOR TOOL POUCH

(71) Applicant: East Gear (International) Corp. Limited, Kowloon (HK)

(72) Inventor: Kwok Ping Fung, Kowloon (HK)

(73) Assignee: EAST GEAR (INTERNATIONAL) CORP. LIMITED, Kowloon (HK)

( * ) Notice: Subject to any disclaimer, the term of this patent is extended or adjusted under 35 U.S.C. 154(b) by 106 days.

(21) Appl. No.: 17/423,395

(22) PCT Filed: May 14, 2020

(86) PCT No.: PCT/IB2020/054562

§ 371 (c)(1),
(2) Date: Jul. 15, 2021

(87) PCT Pub. No.: WO2020/234700

PCT Pub. Date: Nov. 26, 2020

(65) Prior Publication Data

US 2022/0071379 A1 Mar. 10, 2022

(30) Foreign Application Priority Data

May 17, 2019 (HK) ..... 19123954.0

(51) Int. Cl.

| | |
|---|---|
| ***A45F 5/02*** | (2006.01) |
| ***A45F 5/00*** | (2006.01) |
| ***B25H 3/00*** | (2006.01) |

(52) U.S. Cl.

CPC ..... *A45F 5/00* (2013.01); *B25H 3/00* (2013.01); *A45F 2200/0575* (2013.01)

(58) Field of Classification Search

CPC ... Y10S 206/804; B65D 5/4208; A45C 13/02; A45F 5/02

(Continued)

(56) References Cited

U.S. PATENT DOCUMENTS 1,043,889 A * 11/1912 Wood ..... A63B 55/406 206/804
4,541,556 A * 9/1985 Collins ..... B26B 29/025 206/250

(Continued)

FOREIGN PATENT DOCUMENTS

CN 2398888 Y 10/2000
CN 103027457 A 4/2013

(Continued)

*Primary Examiner* — Adam J Waggenspack

(74) *Attorney, Agent, or Firm* — Muncy, Geissler, Olds & Lowe, P.C.

(57) ABSTRACT

A quick slide-out-type outdoor tool pouch, which comprises a pouch body used for holding contents; an opening through which the contents are taken out is provided above the pouch body; the rear end of a pouch cover (2) is connected to the pouch body and may be rotated to cover the opening; a sliding band (1) is provided, the tail end of the sliding band (1) is connected to the inner side of the pouch body by means of a connection place (6), and the connection place (6) is located at the inner side of the pouch body at the side connected to the pouch cover (2); a through-outlet (5) for the sliding band (1) to penetrate is provided on the pouch body at the side opposite to the connection place (6); and after being folded, the front end of the sliding band (1) may be inserted into a holding part (3). The quick slide-out-type outdoor tool pouch enables tools to be taken out quickly, which may increase the timeliness with which tools are taken out in emergency situations.

7 Claims, 8 Drawing Sheets

(58) Field of Classification Search
USPC ..... 224/196; 206/804
See application file for complete search history.

(56) References Cited

U.S. PATENT DOCUMENTS

| | | | | |
|---|---|---|---|---|
| 5,072,867 | A | 12/1991 | Zingale | |
| 7,699,196 | B2 * | 4/2010 | Szabo | A45F 5/02 224/676 |
| 7,918,371 | B2 * | 4/2011 | Wilson | F41A 9/65 224/931 |
| 2003/0197042 | A1 | 10/2003 | Warren | |

FOREIGN PATENT DOCUMENTS

| | | | |
|---|---|---|---|
| CN | 106235570 | A | 12/2016 |
| DE | 20205836 | U1 | 8/2002 |
| DE | 202015103109 | U1 | 7/2015 |
| JP | 2001292821 | A | 10/2001 |

* cited by examiner

QUICK SLIDE-OUT-TYPE OUTDOOR TOOL POUCH

TECHNICAL FIELD

The present invention relates to a tool pouch, particularly to a quick slide-out-type outdoor tool pouch from which the content can be taken out quickly.

BACKGROUND ART

Outdoor tool pouches are hanging bags suitable for military display or for carriage of small tools by outdoorsmen and are generally hung around the waists of the users. Structurally, an outdoor tool pouch comprises at least a pouch body for accommodating content, and a pouch cover for preventing the content from falling out by accident.

For such an existing outdoor tool pouch, in order to prevent the content from falling out, the pouch cover generally needs to have a specific locking structure so that the pouch cover and the pouch body are locked to each other. When the locking function is satisfied, the convenience of quickly taking out the content is sacrificed. The action of taking out the content is not simple. The user needs to unlock and open the pouch cover first and then take out the content. The action is not coherent. Especially when the user needs to operate with one hand during fighting or under harsh outdoor conditions, the defects of the existing product will be more obvious.

SUMMARY OF THE INVENTION

The main technical problem solved by the present invention is to provide a quick slide-out-type outdoor tool pouch, which is faster than the prior art in taking out tools and can significantly improve the timeliness of taking out tools in emergency situations.

The technical means adopted by the present invention is as follows. A quick slide-out-type outdoor tool pouch, comprising a pouch body for accommodating the content, is provided. An opening for taking out the content is arranged on the top of the pouch body. The rear end of the pouch cover is connected to the pouch body and is rotatable to cover the opening. A sliding band is provided, an end of the sliding band is connected to the inner side of the pouch body via a connection place, and the connection place is located on the inner side of the pouch body on a side connected to the pouch cover. A through-outlet for pass-through of the sliding band is opened on a side of the pouch body opposite to the connection place. A holding part is provided on the outer side of the front end of the pouch cover and has at least an upper entrance and the front end of the sliding band can be inserted into the holding part after being folded.

A pouch body lace is provided on the outer side of the pouch body and above the through-outlet and the sliding band can pass between the pouch body lace and the pouch body.

A first fixing structure is provided on the outer side of the holding part of the pouch cover, the sliding band is provided with a second fixing structure in a position corresponding to the first fixing structure, and the first fixing structure and the second fixing structure match each other to form a locking structure.

The first fixing structure is a Velcro tape male portion and the second fixing structure is a Velcro tape female portion, or the first fixing structure is a Velcro tape female portion and the second fixing structure is a Velcro tape male portion.

The second fixing structure is connected to a foldable shielding portion, which can be folded and block the second fixing structure.

The first fixing structure is connected to a foldable shielding portion, which can be folded and block the first fixing structure.

A portion of the sliding band inserted into the holding part is provided with a rigid plate.

The front end of the sliding band is connected to a handle, which protrudes from the holding part The present invention has the following beneficial effects:

1. The quick slide-out-type outdoor tool pouch provided by the present invention can be operated with one hand conveniently. The whole process only needs an action of pulling upward. Operation with both hands is not necessary for taking out the tools. By a simple upward action of a hand, the pouch cover can be opened and the content can be lifted to a position that facilitates taking out. Flexible finger operations are not necessary, either.

2. The pouch cover provided by the present invention may adopt a design of a device without a buckle (e.g., a button) such as a Velcro tape or a magnet. The articles in the pouch can be taken out quickly and silently. The entire pouch may also be made of fabric to achieve a portable and quiet effect.

3. The inner cavity of the pouch does not use auxiliary components and bring the tools out of the pouch opening mainly by pulling the sliding band, thereby retaining a maximum storage space for the inner cavity of the pouch.

4. In coordination with the function of safe locking, the action of taking out is not limited to one direction. The quick slide-out-type outdoor tool pouch provided by the present invention can be used at a plurality of angles and is very convenient.

5. The appearance of the tool pouch is tidy, all sections of the sliding band are tightened with different components, and the tool pouch will not be opened by accident in case of being hooked by a foreign object.

DETAILED DESCRIPTION

Figure 1:
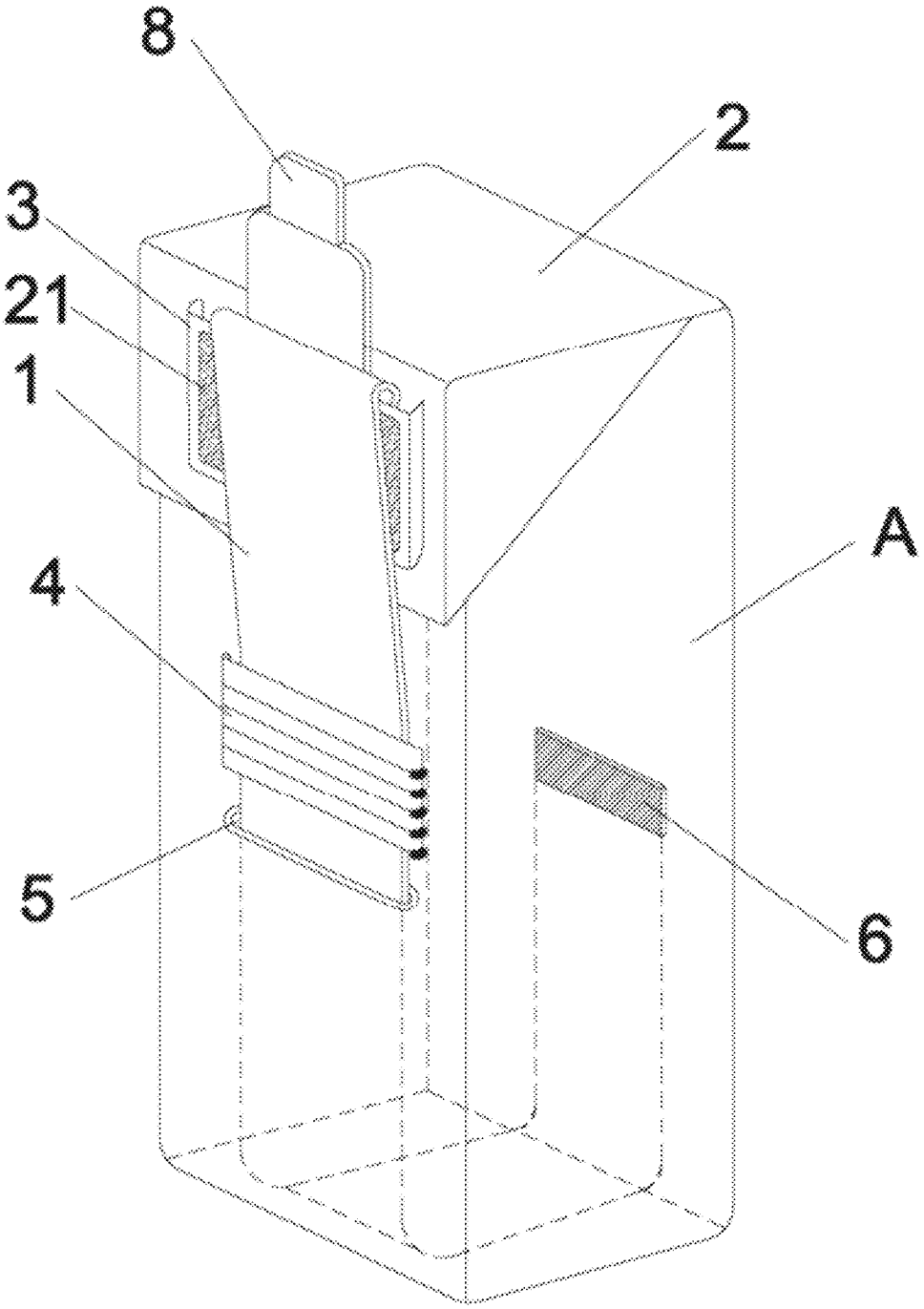
FIG. 1 is a three-dimensional structural schematic view of a quick slide-out-type outdoor tool pouch provided by the present invention, with the pouch cover being in a closed state.
Figure 2:
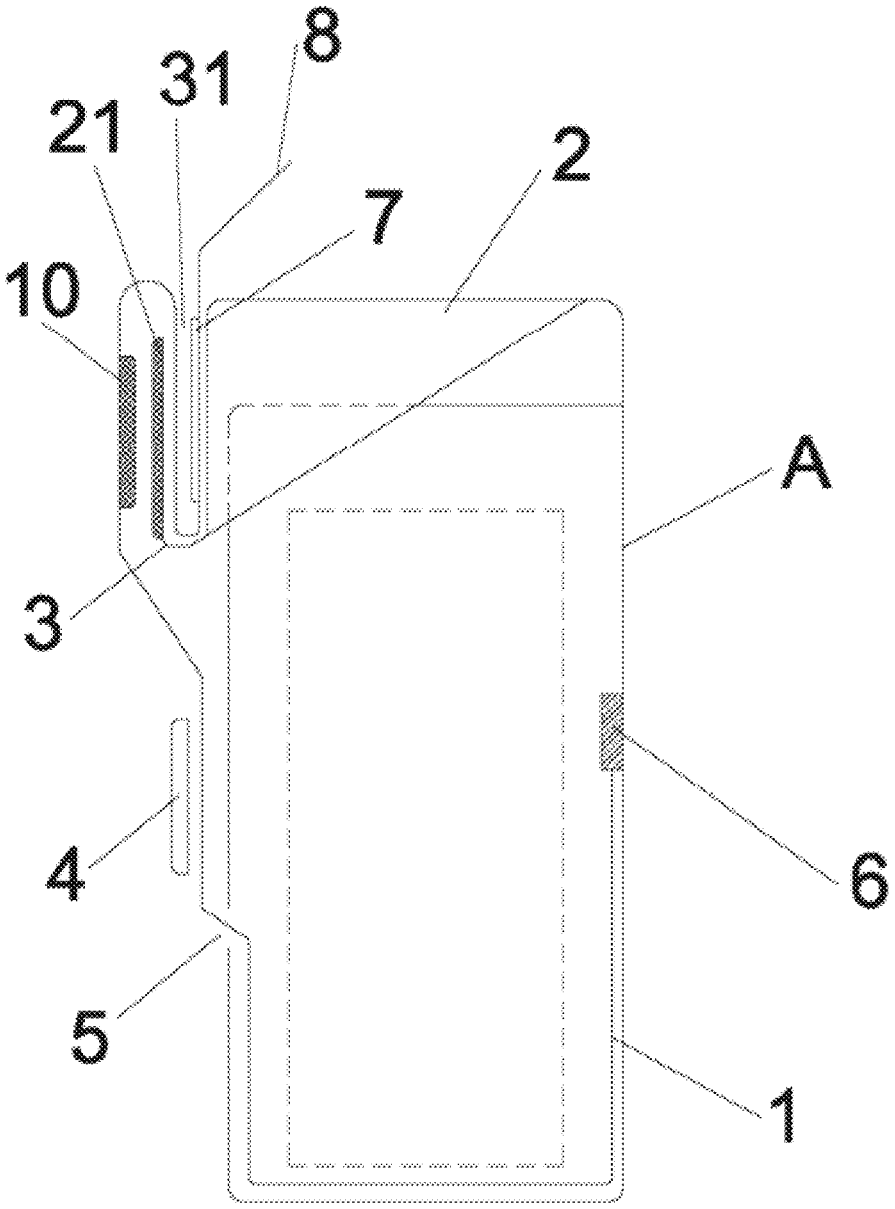
FIG. 2 is a perspective structural schematic view of a quick slide-out-type outdoor tool pouch provided by the present invention, with the pouch cover being in a closed state.

As shown in FIG. 1 and FIG. 2, the present invention provides a quick slide-out-type outdoor tool pouch, comprising a pouch body A for accommodating content, an opening for taking out the content is arranged on the top of the pouch body A, a pouch cover 2 is further provided and the rear end of the pouch cover 2 is connected to the pouch body A and is rotatable to cover the opening. The point is that a sliding band 1 is provided, an end of the sliding band 1 is connected to the inner side of the pouch body A via a connection place 6, and the connection place typically adopts a sewing method. Of course, other common connecting methods such bonding and buckling can be adopted, too. The connection place 6 is located on the inner side of the pouch body on a side connected to the pouch cover 2. The connection place is generally arranged in a position slightly higher than the middle of the pouch body, as shown in the figure and can be adjusted as needed.

A through-outlet 5 for pass-through of the sliding band 1 is opened on a side of the pouch body opposite to the connection place 6. The sliding band 1 passes through the through-outlet.

A holding part 3 is provided on the outer side of the front end of the pouch cover 2 and has at least an upper entrance 31, and the front end of the sliding band 1 can be inserted into the holding part 3 after being folded. The holding part 3 may be a structure closed on three sides and having an entrance on the top, or a structure closed on the left side and the right side and penetrating from top to bottom, as long as the sliding band can be received in the holding part 3 after folding.

Further, a pouch body lace 4 may be provided on the outer side of the pouch body A and above the through-outlet 5, the sliding band can pass between the pouch body lace 4 and the pouch body A, and the pouch body lace 4 may play a role in fixing and guiding the sliding band.

Figure 4A:
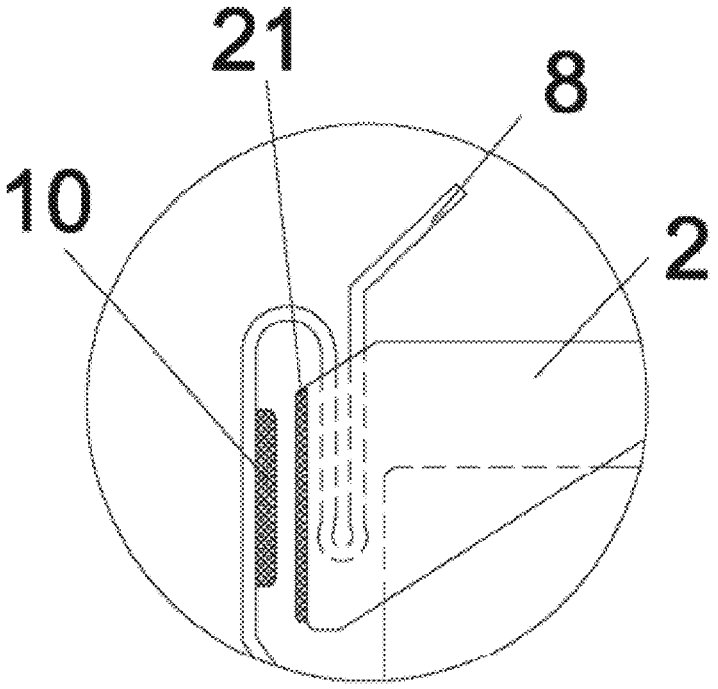
FIG. 4*a* is a perspective structural schematic view of a sliding band inside a holding part 3 according to the present invention.

As shown in FIG. 2 and FIG. 4*a*, in order to achieve the function of safely locking the pouch cover, a first fixing structure 21 is provided on the outer side of the holding part 3 of the pouch cover 2, the sliding band 1 is provided with a second fixing structure 10 in a position corresponding to the first fixing structure 21, and the first fixing structure 21 and the second fixing structure 10 match each other to form a locking structure. In an embodiment of the accompanying drawings, the first fixing structure 21 is a Velcro tape male portion and the second fixing structure 10 is a Velcro tape female portion, or the first fixing structure 21 is a Velcro tape female portion and the second fixing structure 10 is a Velcro tape male portion. The first fixing structure 21 and the second fixing structure 10 are fixed and connected to each other so that when the sliding band 1 is inserted into the holding part, the first fixing structure and the second fixing structure are bonded to each other to realize locking (as shown in FIG. 2), thereby achieving the function of safely locking the pouch cover and preventing the pouch cover from being opened by accident and the content from falling out. In addition to the Velcro tape in this embodiment, the first fixing structure and the second fixing structure may also adopt other existing connecting methods, such as magnet, snap fastener, hook and clamp.

Figure 4B:
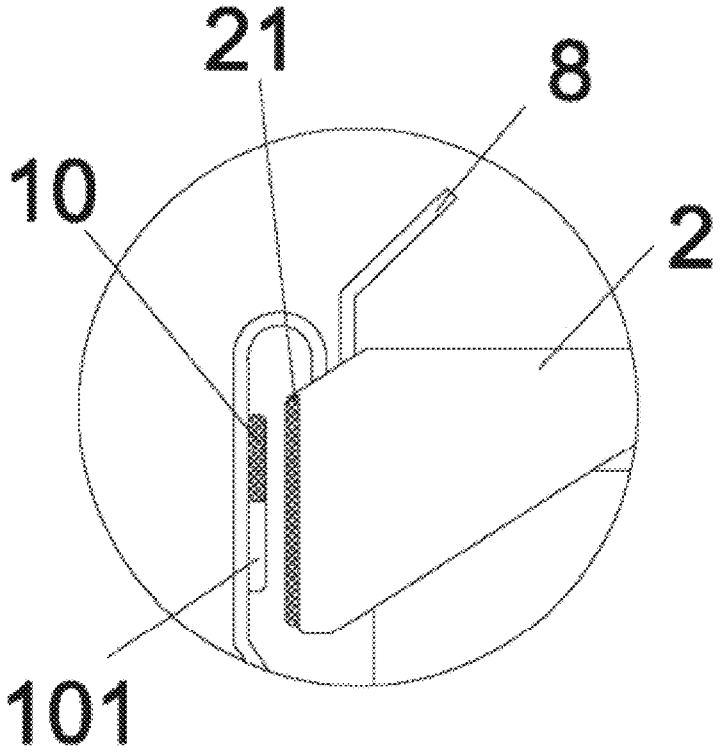
FIG. 4*b* to FIG. 4*d* are perspective structural schematic views showing a process of using a shielding portion according to an alternative embodiment of the present invention.
Figure 4C:
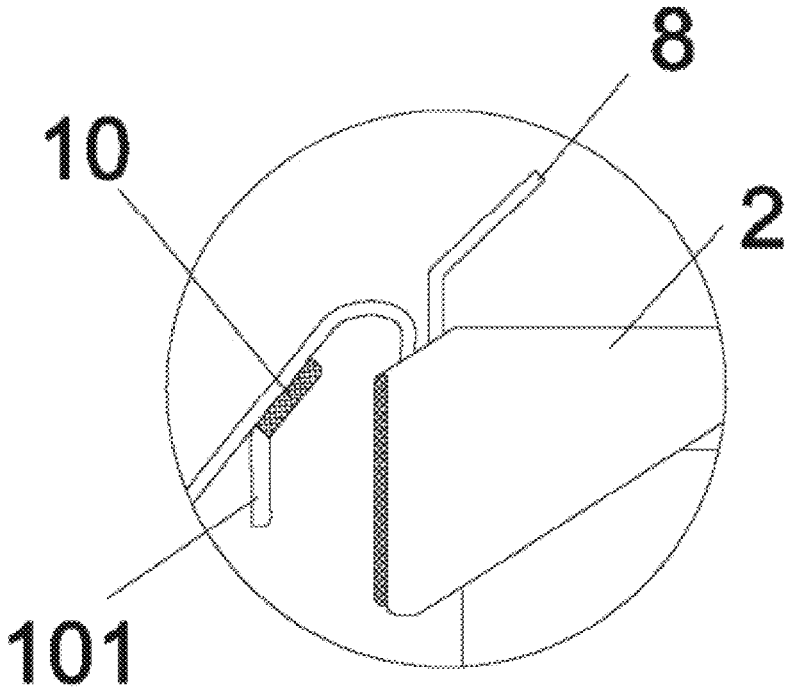
Figure 4D:
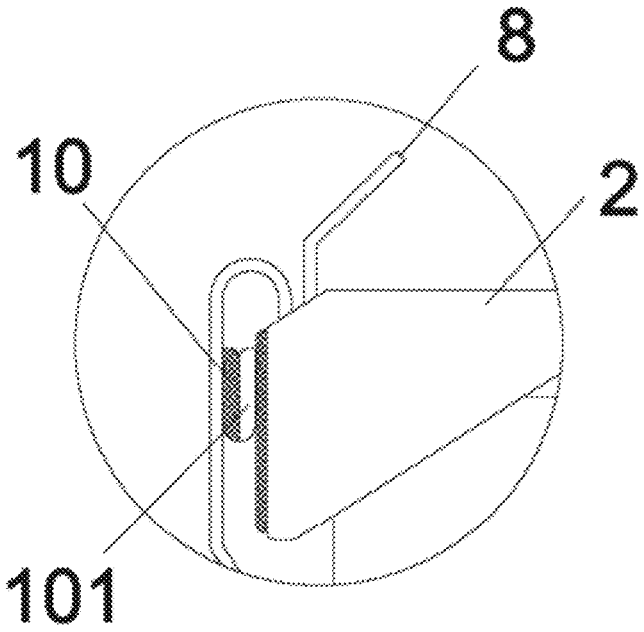

As shown in FIG. 4*c* to FIG. 4*d*, the second fixing structure 10 provided by the present invention may be further connected to a foldable shielding portion 101, which can be folded and block the second fixing structure 10. Taking the second fixing structure as a Velcro tape for example, the shielding portion can be folded and block the second fixing structure and in this case, the locking function of the first fixing structure and the second fixing structure does not work. Although the locking function does not work, certainly the sliding band is pulled more quietly and smoothly, is suitable for different occasions and provides users with more independent options. In FIG. 4*b*, the second fixing structure 10 in FIG. 4*a* is changed into a Velcro tape, a half of the Velcro tape is an occlusive Velcro tape surface and the other half is a shielding portion. When the shielding portion is not folded, as shown in FIG. 4*b*, it can still be occluded with the first fixing structure of the pouch cover to realize the function of safe locking. When the shielding portion as the other half as shown in FIG. 4*c* and FIG. 4*d* are folded and blocks the Velcro tape, the sliding band will not be occluded with the pouch cover and in other words, a faster and quieter tool taking method is provided. The shielding portion in this embodiment and accompanying drawings blocks the second fixing structure. Of course, the shielding portion may also be arranged at the first fixing structure to block the first fixing structure, which will not be elaborated here.

A portion of the sliding band 1 inserted into the holding part 3 is provided with a rigid plate 7. The rigid plate may be a cardboard, a soft rubber sheet or a PP plate and may be sewed into the interior of the sliding band, or as shown in the figure, on the exterior of the sliding band to make this part firm and facilitate the insertion of the sliding band into the holding part. Further, as the rigid plate has a certain thickness, the sliding band may be pressed into the inside of the holding part.

In order to facilitate the pull of the sliding band 1, the front end of the sliding band 1 may be connected to a handle 8, which protrudes from the holding part 3.

The entire tool pouch provided by the present invention as well as the corresponding sliding band and other components may be made of CORDURA® nylon fabric, of which special material structure enables the tool pouch provided by the present invention to play its high wear resistance and high tear resistance. Further, the material is light, soft, waterproof, portable, easy to wash and not easy to change color, greatly increasing the service life. The tool pouch significantly improves the timeliness of emergency rescue in the battlefields or in accidents and greatly facilitates the take-out and reception of tools.

The specific operation mode of the present invention is as shown in FIG. 3*a* to FIG. 3*d*.

Figure 3A:
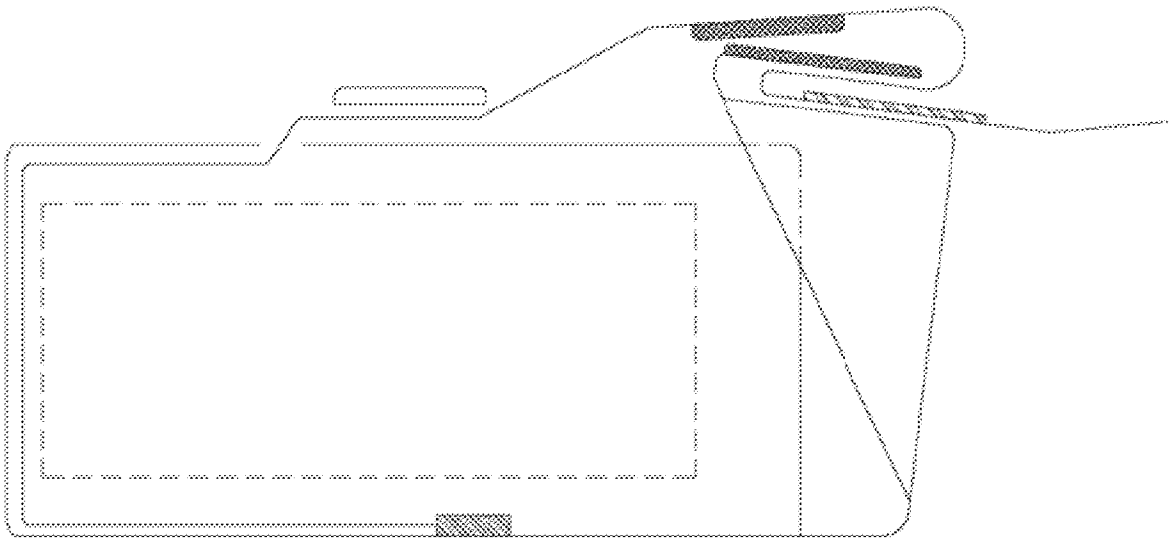
FIG. 3*a* to FIG. 3*d* are perspective structural schematic views showing a process of opening the pouch cover through a sliding band according to the present invention.

As shown in FIG. 3*a*, firstly the sliding band 1 is lifted to slightly open the pouch cover 2.

Figure 3B:
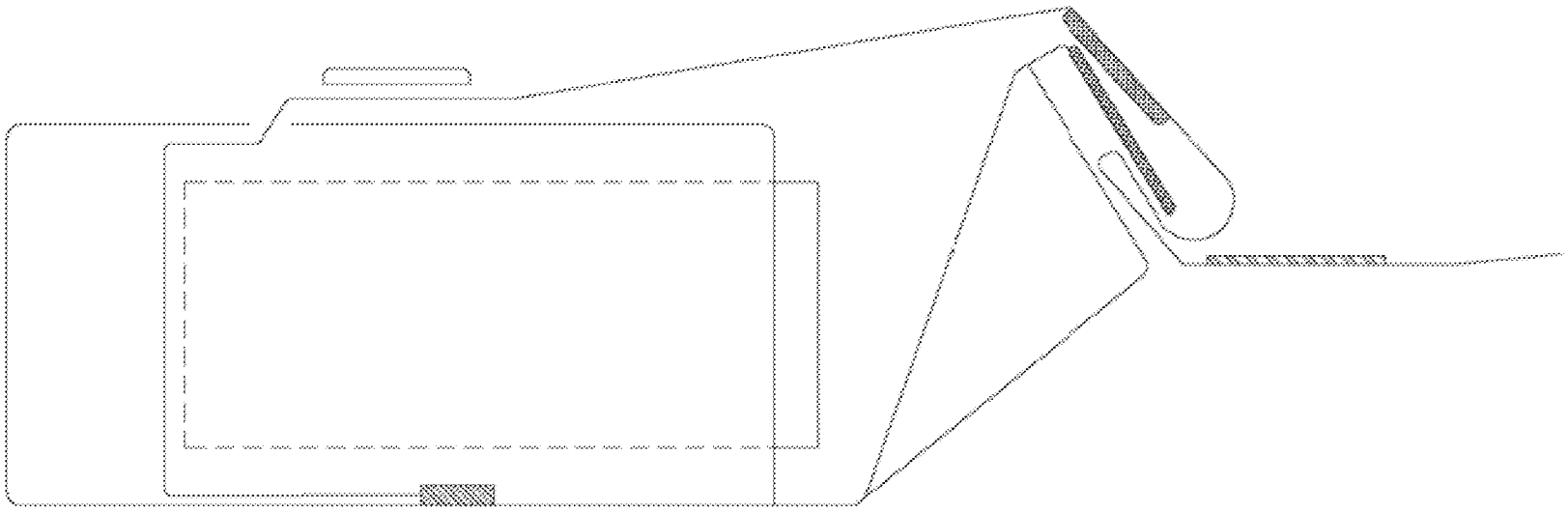

As shown in FIG. 3*b*, the sliding band 1 is partially taken off from above the holding part 3 and the lifting action of the sliding band continues to open the pouch cover. Meanwhile, the sliding band is shortened in the pouch to lift the content. The lifting of the content at the same time can help push the pouch cover open.

Figure 3C:
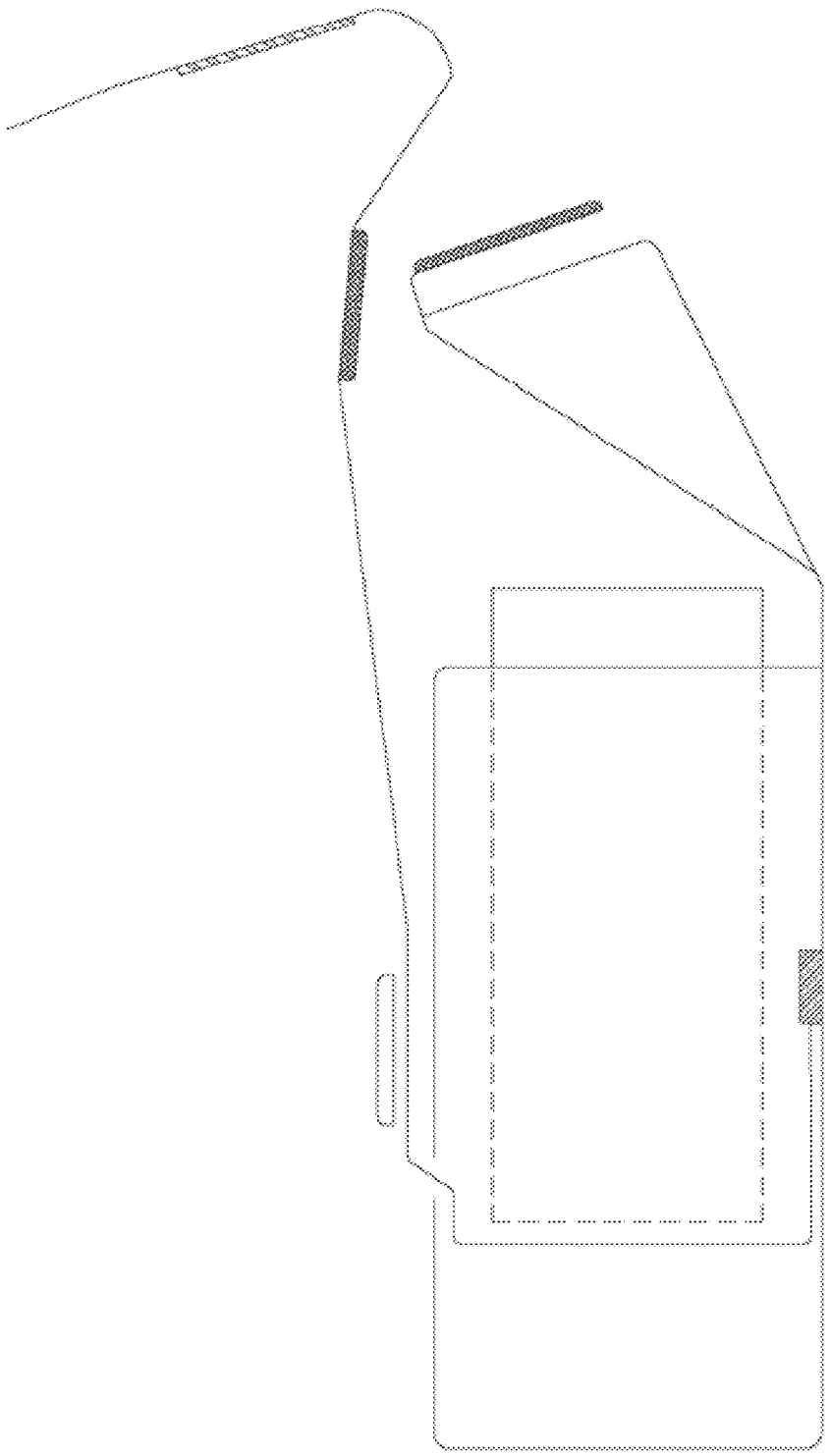

As shown in FIG. 3*c*, the sliding band continues to be lifted and is fully taken off from above the holding part 3 so that the Velcro tape inside the sliding band is disengaged from the Velcro tape in front of the pouch cover to unlock the pouch cover. Meanwhile, the content in the inner cavity of the pouch continues to be lifted until the sliding band in the pouch is shortened to the minimum.

Figure 3D:
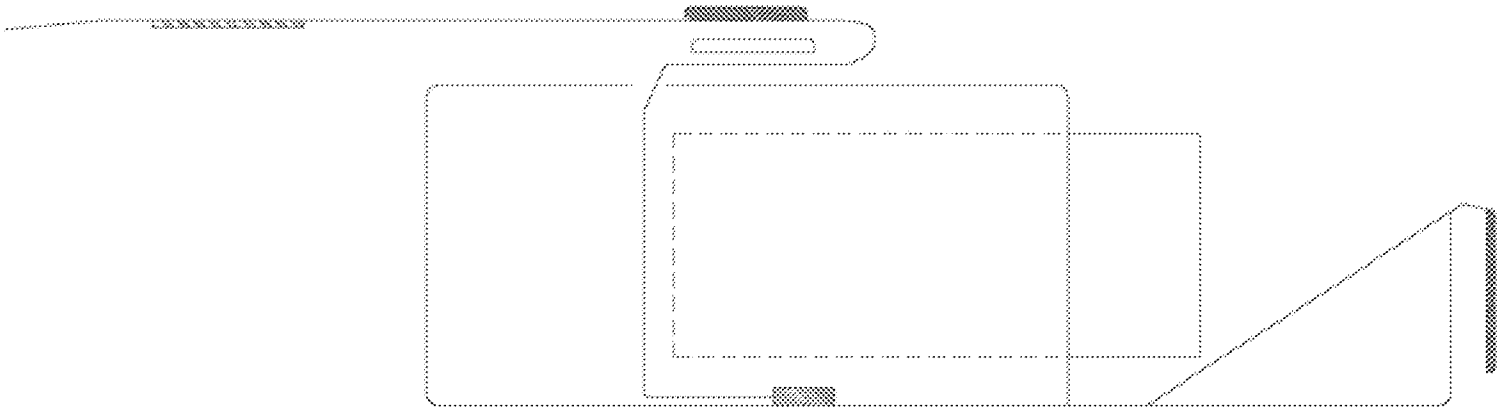

As shown in FIG. 3*d*, the content is lifted to the predetermined position and the top of the content pushes open the pouch cover and is exposed from the inner cavity of the pouch. Now the user can take the object with the other hand. Alternatively, when a light object is taken, the frictional resistance among the sliding band 1, the opening 5 and the pouch body lace 4 can support the content. In this case, the sliding band can be put down and the content will be kept at the predetermined height and can be taken with one hand to complete the action of opening the pouch and taking out the content with one hand.

The invention claimed is:

1. A quick slide-out-type outdoor tool pouch, comprising a pouch body for accommodating content, wherein an opening for taking out the content is arranged on the top of the pouch body;

a pouch cover connected to a first side of the pouch body and is rotatable to cover the opening of the pouch body;

a sliding band having a first end and a second end, the first end being connected to the inner side of the pouch body on the first side of the pouch body via a connection section;

a through-outlet provided on a second side of the pouch body opposite to the first side, the through-outlet being an opening for pass-through of the sliding band;

a holding part provided on the outer side of the front end of the pouch cover and having at least an upper entrance, the second end of the sliding band being insertable into the holding part while the sliding band is folded; and a first fixing structure provided on the outer side of the holding part of the pouch cover, wherein the sliding band is provided with a second fixing structure in a position corresponding to the first fixing structure, and the first fixing structure and the second fixing structure match each other to form a locking structure.

2. The quick slide-out-type outdoor tool pouch according to claim 1, further comprising a pouch body lace provided on the outer side of the pouch body and between the through-outlet and the opening of the pouch body, wherein the sliding band can pass between the pouch body lace and the pouch body.

3. The quick slide-out-type outdoor tool pouch according to claim 1, wherein the first fixing structure is a male portion of a hook-and-loop fastener and the second fixing structure is female portion of the hook-and-loop fastener, or the first fixing structure is the female portion of the hook-and-loop fastener and the second fixing structure is the male portion of the hook-and-loop fastener.

4. The quick slide-out-type outdoor tool pouch according to claim 1, wherein the second fixing structure is connected to a foldable shielding portion, which can be folded and block the second fixing structure.

5. The quick slide-out-type outdoor tool pouch according to claim 1, wherein the first fixing structure is connected to a foldable shielding portion, which can be folded and block the first fixing structure.

6. The quick slide-out-type outdoor tool pouch according to claim 1, wherein a portion of the sliding band inserted into the holding part is provided with a rigid plate.

7. The quick slide-out-type outdoor tool pouch according to claim 1, wherein the front end of the sliding band is connected to a handle, which protrudes from the holding part.

* * * * *